US009624558B2

(12) United States Patent
Omoto et al.

(10) Patent No.: US 9,624,558 B2
(45) Date of Patent: Apr. 18, 2017

(54) BLAST-FURNACE BLOWING COAL AND METHOD FOR PRODUCING SAME

(71) Applicant: MITSUBISHI HEAVY INDUSTRIES, LTD., Tokyo (JP)

(72) Inventors: Setsuo Omoto, Tokyo (JP); Keiichi Nakagawa, Tokyo (JP); Tsutomu Hamada, Tokyo (JP); Masakazu Sakaguchi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 156 days.

(21) Appl. No.: 14/413,877

(22) PCT Filed: Apr. 25, 2013

(86) PCT No.: PCT/JP2013/062156

§ 371 (c)(1),
(2) Date: Jan. 9, 2015

(87) PCT Pub. No.: WO2014/027480

PCT Pub. Date: Feb. 20, 2014

(65) Prior Publication Data

US 2015/0191804 A1 Jul. 9, 2015

(30) Foreign Application Priority Data

Aug. 13, 2012 (JP) ..... 2012-179240

(51) Int. Cl.

| | |
|---|---|
| ***C21B 5/00*** | (2006.01) |
| ***C21B 5/04*** | (2006.01) |
| ***C22B 1/242*** | (2006.01) |
| ***C10L 5/36*** | (2006.01) |

(Continued)

(52) U.S. Cl.

CPC ..... *C21B 5/007* (2013.01); *C10B 53/04* (2013.01); *C10B 57/04* (2013.01); *C10L 5/366* (2013.01);

(Continued)

(58) Field of Classification Search

CPC ..... C21B 5/003; C21B 5/007; C10L 5/366; C10B 53/04; C10B 57/04; C22B 1/242

See application file for complete search history.

(56) References Cited

U.S. PATENT DOCUMENTS 4,428,769 A * 1/1984 Limpach ..... C21B 5/003 75/460

FOREIGN PATENT DOCUMENTS

CN 103060054 A * 4/2013
JP 05-156330 A 6/1993

(Continued)

OTHER PUBLICATIONS

Jiang Song et al. CN 103060054 A published Apr. 2013 machine translation.*

(Continued)

*Primary Examiner* — George Wyszomierski
*Assistant Examiner* — Tima M McGuthry Banks
(74) *Attorney, Agent, or Firm* — Westerman, Hattori, Daniels & Adrian, LLP

(57) ABSTRACT

A method for producing blast-furnace blowing coal to be blown through a tuyere into the interior of the blast-furnace body of a blast furnace, wherein: the composition and melting point of the ash from the coal are analyzed in advance; the composition of the blast-furnace slag is analyzed in advance; the blast-furnace slag contains more calcium oxide than the coal ash does; and the coal and the blast-furnace slag are mixed, on the basis of the composition and melting point of the coal ash and the composition of the blast-furnace slag, and in a manner such that the amount of calcium oxide contained in a quaternary system phase diagram including silicon dioxide, magnesium oxide, aluminum oxide and calcium oxide, which are the principal (Continued)

components of the coal ash and the blast-furnace slag, causes the melting point of the ash to be 1400° C. or higher.

3 Claims, 2 Drawing Sheets

(51) Int. Cl.

| | |
|---|---|
| ***C10B 53/04*** | (2006.01) |
| ***C10B 57/04*** | (2006.01) |
| ***C21B 3/08*** | (2006.01) |
| ***C21B 5/02*** | (2006.01) |

(52) U.S. Cl.
CPC ..... *C21B 3/08* (2013.01); *C21B 5/001* (2013.01); *C21B 5/003* (2013.01); *C21B 5/008* (2013.01); *C21B 5/023* (2013.01); *C21B 5/04* (2013.01); *C22B 1/242* (2013.01)

(56) References Cited

FOREIGN PATENT DOCUMENTS

| | | | |
|---|---|---|---|
| JP | 11-152508 | A | 6/1999 |
| JP | 2001-294911 | A | 10/2001 |
| JP | 2001-323307 | A | 11/2001 |

OTHER PUBLICATIONS

Notification of Transmittal of Translation of the International Preliminary Report on Patentability (Form PCT/IB/338) of International Application No. PCT/JP2013/062156 mailed Feb. 26, 2015 with Forms PCT/IB/373, PCT/ISA/237, PCT/ISA/220 and PCT/ISA/210 (13 pages).

* cited by examiner

BLAST-FURNACE BLOWING COAL AND METHOD FOR PRODUCING SAME

TECHNICAL FIELD

The present invention relates to blast-furnace injecting coal and a method for producing the same.

BACKGROUND ART

Blast furnaces have been configured such that pig iron can be produced from iron ore by charging iron ore, calcium oxide and coke starting materials from the top to the interior of the blast-furnace body and injecting in hot wind and blast-furnace injecting pulverized coal as an auxiliary fuel from a tuyere on the bottom side of the side part of the blast-furnace body.

In order to stably operate the above blast furnaces, it is necessary to suppress adhesion of the blast-furnace-injecting-coal ash or blockages caused by the blast-furnace-injecting-coal ash along the path of the blast-furnace injecting coal to the interior of the blast-furnace body.

For example, it has been proposed to improve combustibility of blast-furnace injecting coal by adding a CaO-based flux such as calcium oxide or serpentinite to pulverized coal of which the melting point of the pulverized coal ash is less than 1300° C., thereby adjusting the melting point of the ash in the pulverized coal to not less than 1300° C., and then injecting only the pulverized coal of which the melting point of the pulverized coal ash is not less than 1300° C. into the interior from the tuyere of the blast-furnace body (for example, refer to Patent Document 1 below).

Additionally, for example, a blast-furnace pulverized coal injecting operating method has been proposed, whereby permeability can be improved even in operations where the amount of injected pulverized coal is extremely large by regulating the amount of enriched oxygen or adjusting the composition, particle size, or the like of the pulverized coal to make it poorly combustible to reduce the maximum temperature reached in the raceway (for example, refer to Patent Document 2 below).

PRIOR ART DOCUMENT

Patent Literature

Patent Document 1: Japanese Unexamined Patent Application Publication No. H05-156330A
(for example, refer to paragraphs [0014]-[0023] of Specification, FIG. 1, and the like)

Patent Document 2: Japanese Unexamined Patent Application Publication No. H11-152508A

SUMMARY OF INVENTION

Technical Problem

However, the pulverized coal (blast-furnace injecting coal) described in Patent Document 1 causes an increase in running cost because only the pulverized coal of which the ash melting point has been adjusted to not less than 1300° C. by intentionally adding the flux to pulverized coal is used.

Furthermore, the blast-furnace pulverized coal injecting operating method described in Patent Document 2 ends up causing an increase in running cost because the amount of injected pulverized coal is extremely large and the composition and particle size of the pulverized coal must be intentionally adjusted.

Due to such facts, the present invention was devised to solve the problems described above, and an object thereof is to provide blast-furnace injecting coal which is low in cost and capable of suppressing adhesion of blast-furnace-injecting-coal ash and blockages caused by the blast-furnace-injecting-coal ash along the path of the blast-furnace injecting coal to the interior of the blast-furnace body, and a method for producing the same.

Solution to Problem

The blast-furnace injecting coal according to a first invention which solves the above problems is blast-furnace injecting coal which is injected through a tuyere into an interior of a blast-furnace body of a blast furnace; a composition and a melting point of coal ash being analyzed in advance and a composition of iron and steel slag produced by an iron and steel production step being analyzed in advance; the iron and steel slag containing more calcium oxide than the coal ash does; and the coal and the iron and steel slag being mixed, on the basis of the composition and melting point of the coal ash and the composition of the iron and steel slag, and in a manner such that a content of calcium oxide contained in a quaternary system phase diagram including silicon dioxide, magnesium oxide, aluminum oxide and calcium oxide, which are principal components of the coal ash and the iron and steel slag, causes the melting point of the ash to be 1400° C. or higher.

The blast-furnace injecting coal according to a second invention which solves the above problems is the blast-furnace injecting coal according to the first invention, wherein the coal has been pulverized to an average particle size of not greater than 1 mm, and the iron and steel slag has been pulverized to a particle size of 20 μm to 100 μm.

The blast-furnace injecting coal according to a third invention which solves the above problems is the blast-furnace injecting coal according to the first invention, wherein the blast-furnace injecting coal is formed by adding a binder and water to a mixture of the coal and the iron and steel slag and molding into briquettes.

The blast-furnace injecting coal according to a fourth invention which solves the above problems is the blast-furnace injecting coal according to the second invention, wherein the blast-furnace injecting coal is formed by adding a binder and water to a mixture of the coal and the iron and steel slag and molding into briquettes.

The method for producing blast-furnace injecting coal according to a fifth invention which solves the above problems is a method for producing blast-furnace injecting coal which produces blast-furnace injecting coal to be injected through a tuyere into an interior of a blast-furnace body of a blast furnace, the method comprising performing: an analysis step of analyzing a composition and a melting point of coal ash and analyzing a composition of an iron and steel slag produced by an iron and steel production step; and a mixing step, in which the iron and steel slag contains more calcium oxide than the coal ash does, and the coal and the iron and steel slag are mixed on the basis of the composition and melting point of the coal ash and the composition of the iron and steel slag, and in a manner such that a content of calcium oxide contained in a quaternary system phase diagram including silicon dioxide, magnesium oxide, aluminum oxide and calcium oxide, which are principal components of the coal ash and the iron and steel slag, causes the melting point of the ash to be 1400° C. or higher.

The method for producing blast-furnace injecting coal according to a sixth invention which solves the above problems is the method for producing blast-furnace injecting coal according to the fifth invention, wherein the coal has been pulverized to an average particle size of not greater than 1 mm, and the iron and steel slag has been pulverized to a particle size of 20 μm to 100 μm.

The method for producing blast-furnace injecting coal according to a seventh invention which solves the above problems is the method for producing blast-furnace injecting coal according to the sixth invention, the method further comprising performing: in the mixing step, further adding a binder and water, and mixing with the coal and the iron and steel slag; and a molding step in which the mixture obtained in the mixing step is molded into briquettes.

Advantageous Effects of Invention

According to the blast-furnace injecting coal according to the present invention, by mixing coal and iron and steel slag such that the calcium oxide content causes the melting point of the ash to be 1400° C. or higher, the melting point of the ash becomes 100° C. to 150° C. higher than the temperature of the hot wind injected into the interior from the tuyere of the blast-furnace body or even higher, and the iron and steel slag is discharged in the iron and steel production process. As a result, the iron and steel slag can be effectively utilized, and it is unnecessary to separately provide a calcium oxide source that is mixed with the coal, and adhesion of the blast-furnace-injecting-coal ash and blockages caused by the blast-furnace-injecting-coal ash along the path of the blast-furnace injecting coal to the interior of the blast-furnace body can be suppressed at low cost.

Additionally, according to the method for producing blast-furnace injecting coal according to the present invention, the blast-furnace injecting coal described above can be produced easily and at low cost.

DESCRIPTION OF EMBODIMENTS

Embodiments of the blast-furnace injecting coal and the method for producing the same according to the present invention will be described based on drawings, but the present invention is not limited only to the embodiments described below based on drawings.

First Embodiment

A first embodiment of the blast-furnace injecting coal and the method for producing the same according to the present invention will be described based on FIG. 1.

In the blast-furnace injecting coal according to this embodiment, the composition and melting point of the coal ash are analyzed in advance and the composition of the blast-furnace slag discharged from a blast furnace is analyzed in advance, and the blast-furnace slag contains more calcium oxide than the coal ash does, and the coal and the blast-furnace slag are mixed based on the composition and melting point of the coal ash and the composition of the blast-furnace slag, and in a manner such that the content of calcium oxide contained in a quaternary system phase diagram including silicon dioxide, magnesium oxide, aluminum oxide and calcium oxide, which are the principal components of the coal ash and the blast-furnace slag, causes the melting point of the ash to be 1400° C. or higher, which is higher than the temperature of the hot wind (1200° C.) injected into the interior from the tuyere on the bottom side of the side part of the blast-furnace body of the blast furnace.

Figure 1:
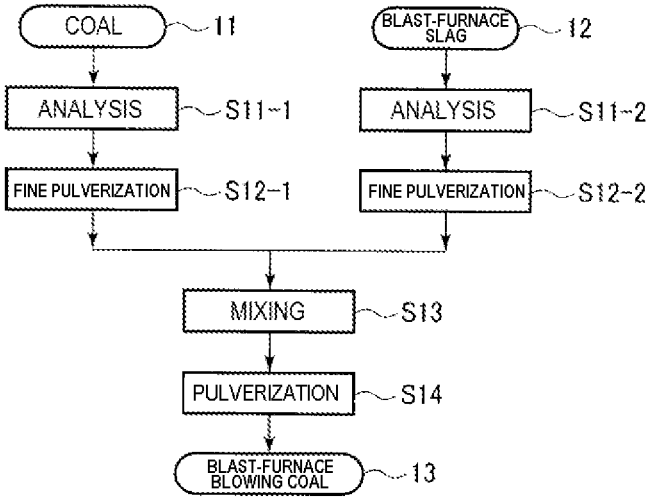
FIG. 1 is a flowchart illustrating the procedure of a first embodiment of the method for producing blast-furnace injecting coal according to the present invention.

The blast-furnace injecting coal 13 according to this embodiment may be easily produced by analyzing the composition of the coal 11, which is low-grade coal such as sub-bituminous coal or lignite, and the melting point of the ash thereof (analysis step S11-1), and analyzing the composition of the blast-furnace slag 12 discharged from the blast furnace (analysis step S11-2), and then finely pulverizing the coal 11 (fine pulverization step S12-1) and finely pulverizing the blast-furnace slag 12 (fine pulverization step S12-2), and then mixing the coal 11 and the blast-furnace slag 12 (mixing step S13), and pulverizing the mixture (pulverization step S14) as shown in FIG. 1. Furthermore, the pulverization step S14 is preferably performed immediately before injecting into the blast furnace.

The calcium oxide content of the blast-furnace slag 12 is, for example, 41.7 wt. %, and is greater than the calcium oxide content of the ash from the coal 11.

In the fine pulverization step S12-1, the coal 11 is finely pulverized to an average particle size of not greater than 1 mm. This is because, if the coal 11 has an average particle size greater than 1 mm, it is difficult to homogenize when mixed with the blast-furnace slag 12 in the mixing step S13.

In the fine pulverization step S12-2, the blast-furnace slag 12 is finely pulverized to a particle size of 20 μm to 100 μm. This is because, if the blast-furnace slag 12 has a particle size smaller than 20 μm, when injected into the interior of the blast-furnace body, it passes through the interior of the blast-furnace body while carried on the gas stream, and ends up being discharged without combusting. If the blast-furnace slag 12 has a particle size greater than 100 μm, it is difficult to homogenize when mixed with the coal 11 in the mixing step S13.

In the blast-furnace injecting coal 13 produced by the production method according to this embodiment, by mixing the coal 11 and the blast-furnace slag 12 such that the calcium oxide content causes the melting point of the ash to be 1400° C. or higher, the melting point of the ash becomes 100° C. to 150° C. higher than the temperature of the hot wind injected into the interior from the tuyere of the blast-furnace body or even higher, and the ash from the blast-furnace injecting coal 13 (blast-furnace-injecting-coal ash) is not melted by the hot wind, and as a result, adhesion of the blast-furnace-injecting-coal ash or blockages caused by the blast-furnace-injecting-coal ash along the path of the blast-furnace injecting coal to the interior of the blast-furnace body can be suppressed. Furthermore, because the blast-furnace slag 12 is discharged in the iron and steel production process of the blast furnace, the blast-furnace slag 12 can be effectively utilized, and it is unnecessary to separately provide a calcium oxide source mixed with the coal 11, and thus cost is low.

For this reason, with the blast-furnace injecting coal 13 according to this embodiment, simply by causing the coal 11 to contain the blast-furnace slag 12 discharged from the blast furnace, which contains more calcium oxide than the ash from the coal 11, even without additionally adding flux such as calcium oxide or serpentinite, it is possible to increase the melting point of the ash from the blast-furnace injecting coal 13 (blast-furnace-injecting-coal ash) to 1400° C. or higher even though the melting point of the ash from the coal 11 is a low temperature of 1100° C. to 1300° C., and the ash from the blast-furnace injecting coal 13 (blast-furnace-injecting-coal ash) is not melted even by the hot wind. As a result, adhesion of the blast-furnace-injecting-coal ash or blockages caused by the blast-furnace-injecting-coal ash along the path of the blast-furnace injecting coal to the interior of the blast-furnace body can be suppressed.

Therefore, according to this embodiment, adhesion of the blast-furnace-injecting-coal ash or blockages caused by the blast-furnace-injecting-coal ash along the path of the blast-furnace injecting coal to the interior of the blast-furnace body can be suppressed at low cost.

Furthermore, in the blast-furnace injecting coal and the method for producing the same according to this embodiment, the case where blast-furnace slag 12 having a greater calcium oxide content than the ash composition of the coal is used as the iron and steel slag mixed with the coal 11 has been described, but iron and steel slag having a greater calcium oxide content than the ash composition of the coal produced in the iron and steel production process, for example, converter slag discharged by converter equipment (for example, having calcium oxide content of about 45.8 wt. %), or, for example, reducing slag produced by dissolution/reducing smelting of iron scrap (for example, having calcium oxide content of about 55.1 wt. %) may also be used.

Second Embodiment

A second embodiment of the blast-furnace injecting coal and the method for producing the same according to the present invention will be described based on FIG. 2. Note that, for parts that are the same as the above embodiment, the same reference numerals as those used in the description of the above embodiment are used, and therefore duplicate descriptions of the above embodiment are omitted.

In the blast-furnace injecting coal according to this embodiment, the composition and melting point of the coal ash are analyzed in advance and the composition of the blast-furnace slag discharged from the blast furnace is analyzed in advance, and the blast-furnace slag contains more calcium oxide than the coal ash does, and the coal and the blast-furnace slag are mixed, on the basis of the composition and melting point of the coal ash and the composition of the blast-furnace slag, and in a manner such that the content of calcium oxide contained in a quaternary system phase diagram including silicon dioxide, magnesium oxide, aluminum oxide and calcium oxide, which are the principal components of the coal ash and the blast-furnace slag, causes the melting point of the ash to be 1400° C. or higher, which is higher than the temperature of the hot wind (1200° C.) injected into the interior from the tuyere on the bottom side of the side part of the blast-furnace body of the blast furnace, and a binder and water are further mixed in.

Figure 2:
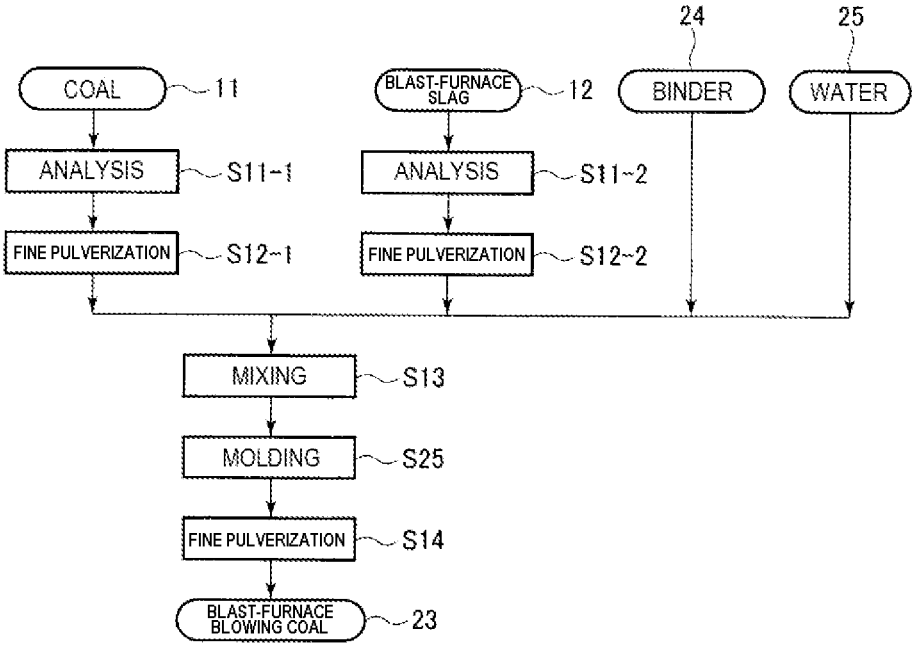
FIG. 2 is a flowchart illustrating the procedure of a second embodiment of the method for producing blast-furnace injecting coal according to the present invention.

The blast-furnace injecting coal 23 according to this embodiment may be easily produced by analyzing the composition of the coal 11, which is the low-grade coal described above, and the melting point of the ash thereof in the same manner as in the above embodiment (analysis step S11-1), and analyzing the composition of the blast-furnace slag 12 discharged from the blast furnace in the same manner as in the above embodiment (analysis step S11-2), and then finely pulverizing the coal 11 in the same manner as in the above embodiment (fine pulverization step S12-1) and finely pulverizing the blast-furnace slag 12 in the same manner as in the above embodiment (fine pulverization step S12-2), and then mixing the coal 11 and the blast-furnace slag 12 with a binder 24 and water 25 (mixing step S13), molding the mixture into briquettes (molding step S25), and pulverizing the briquette-shaped molded articles (pulverization step S14) as shown in FIG. 2. Furthermore, the pulverization step S14 is preferably performed immediately before injecting into the blast furnace.

In short, in this embodiment, by molding a mixture obtained by mixing the coal 11 and the blast-furnace slag 12 with the binder 24 and the water 25 in the mixing step S13 into briquettes in the molding step S25, blast-furnace injecting coal 23 is obtained by homogenizing the silicon dioxide, magnesium oxide, aluminum oxide and calcium oxide which are the principal components of the ash from the coal 11 and the blast-furnace slag 12, and pulverizing in the pulverization step S14.

The calcium oxide content of the blast-furnace slag 12 is, for example, 41.7 wt. %, and is greater than the calcium oxide content of the ash from the coal 11.

As the binder 24, a binder that enables molding of the mixture into briquettes in the molding step S25, that hardly affects the melting point of the ash from the blast-furnace injecting coal 23 (blast-furnace-injecting-coal ash), and that is completely combusted in the blast furnace may be used, examples of which include cornstarch, molasses, asphalt and the like.

The mixed amount of the binder 24 is an amount that enables molding of the mixture of the coal 11 and the blast-furnace slag 12 into pellets, for example, an amount in a range of 1 wt. % to 5 wt. % with respect to the mixture of the coal 11 and the blast-furnace slag 12. This is because, if the mixed amount of binder 24 is less than 1 wt. %, the mixture of the coal 11 and the blast-furnace slag 12 cannot be molded into briquettes, and if the mixed amount of binder 24 is greater than 5 wt. %, running cost increases. The mixed amount of water 25 is an amount that enables molding of the mixture of the coal 11 and the blast-furnace slag 12 into pellets, for example, an amount in a range of 2 wt. % to 8 wt. % with respect to the mixture of the coal 11 and the blast-furnace slag 12. This is because, if the mixed amount of water 25 is less than 2 wt. %, the mixture of the coal 11 and the blast-furnace slag 12 cannot be molded into briquettes, and if the mixed amount of water 25 is greater than 8 wt. %, excess energy ends up being consumed in the pulverization and drying steps in the blast furnace due to evaporation of moisture.

In short, in this embodiment, because a binder 24 and water 25 are added to and further mixed with the mixture of the coal 11 and the blast-furnace slag 12, by molding that mixture into pellets in the molding step S25, the silicon dioxide, magnesium oxide, aluminum oxide, calcium oxide, and the like which are the principal components are homogenized, and ease of handling (transport, storage, and the like) is improved.

In the blast-furnace injecting coal 23 produced by the production method according to this embodiment, similar to the embodiment described above, by mixing the coal 11 and the blast-furnace slag 12 such that the calcium oxide content causes the melting point of the ash to be 1400° C. or higher, the melting point of the ash becomes 100° C. to 150° C. higher than the temperature of the hot wind injected into the interior from the tuyere of the blast-furnace body or even higher, and the ash from the blast-furnace injecting coal 23 (blast-furnace-injecting-coal ash) is not melted by the hot wind, and as a result, adhesion of the blast-furnace-injecting-coal ash or blockages caused by the blast-furnace-injecting-coal ash along the path of the blast-furnace injecting coal to the interior of the blast-furnace body can be suppressed. Furthermore, because the blast-furnace slag 12 is discharged in the iron and steel production process of the blast furnace, the blast-furnace slag 12 can be effectively utilized, and it is unnecessary to separately provide a calcium oxide source mixed with the coal 11, and thus cost is low.

Because the mixture of the coal 11, the blast-furnace slag 12, the binder 24, and the water 25 is molded into briquettes in the molding step S25 and then pulverized in the pulverization step S14, silicon dioxide, magnesium oxide, aluminum oxide and calcium oxide are homogenized, and, more so than in the above embodiment, blast-furnace injecting coal can be injected into the interior from the tuyere on the bottom side of the side part of the blast-furnace body without further generating adhesion of the blast-furnace-injecting-coal ash or blockages caused by the blast-furnace-injecting-coal ash along the path of the blast-furnace injecting coal to the interior of the blast-furnace body.

For this reason, with the blast-furnace injecting coal 23 according to this embodiment, simply by causing the coal 11 to contain the blast-furnace slag 12 discharged from the blast furnace, which contains more calcium oxide than the ash from the coal 11, even without additionally adding flux such as calcium oxide or serpentinite, more so than in the above embodiment, it is possible to reliably increase the melting point of the ash from the blast-furnace injecting coal 13 (blast-furnace-injecting-coal ash) to 1400° C. or higher even though the melting point of the ash from the coal 11 is a low temperature of 1100° C. to 1300° C., and the ash from the blast-furnace injecting coal 23 (blast-furnace-injecting-coal ash) is not melted even by the hot wind. As a result, adhesion of the blast-furnace-injecting-coal ash or blockages caused by the blast-furnace-injecting-coal ash along the path of the blast-furnace injecting coal to the interior of the blast-furnace body can be suppressed.

Therefore, according to this embodiment, adhesion of the blast-furnace-injecting-coal ash or blockages caused by the blast-furnace-injecting-coal ash along the path of the blast-furnace injecting coal to the interior of the blast-furnace body can be more reliably suppressed than in the above embodiment, at low cost.

EXAMPLES

Working examples for ascertaining the effect of the blast-furnace injecting coal and the method for producing the same according to the present invention will be described below, but the present invention is not limited only to the working examples below which are described based on various data.

Compositional analysis (elemental analysis) of the ash from the coal used in the method for producing blast-furnace injecting coal according to the second embodiment described above was performed. This coal was modified coal obtained by heat-treating sub-bituminous coal for 0.5 hours in an inert atmosphere (for example, nitrogen gas) at 400° C. The ash content in the coal was 7 wt. %. The results of compositional analysis of the coal ash (principal components) are shown in Table 1 below. Furthermore, from FIG. 3, which illustrates a quaternary system phase diagram including silicon dioxide, magnesium oxide, calcium oxide and aluminum oxide, it is clear that the melting point of the coal ash is 1215° C., since the composition shown in Table 1 below results in the position of point P1.

TABLE 1

| $SiO_2$ (wt. %) | CaO (wt. %) | $Al_2O_3$ (wt. %) | MgO (wt. %) |
|---|---|---|---|
| 41 | 30 | 22 | 7 |

Compositional analysis (elemental analysis) of the blast-furnace slag used in the method for producing blast-furnace injecting coal according to the second embodiment described above was performed. The results of compositional analysis of the blast-furnace slag (principal components) are shown in Table 2 below.

TABLE 2

| $SiO_2$ (wt. %) | CaO (wt. %) | $Al_2O_3$ (wt. %) | MgO (wt. %) |
|---|---|---|---|
| 34 | 42 | 13 | 8 |

Figure 3:
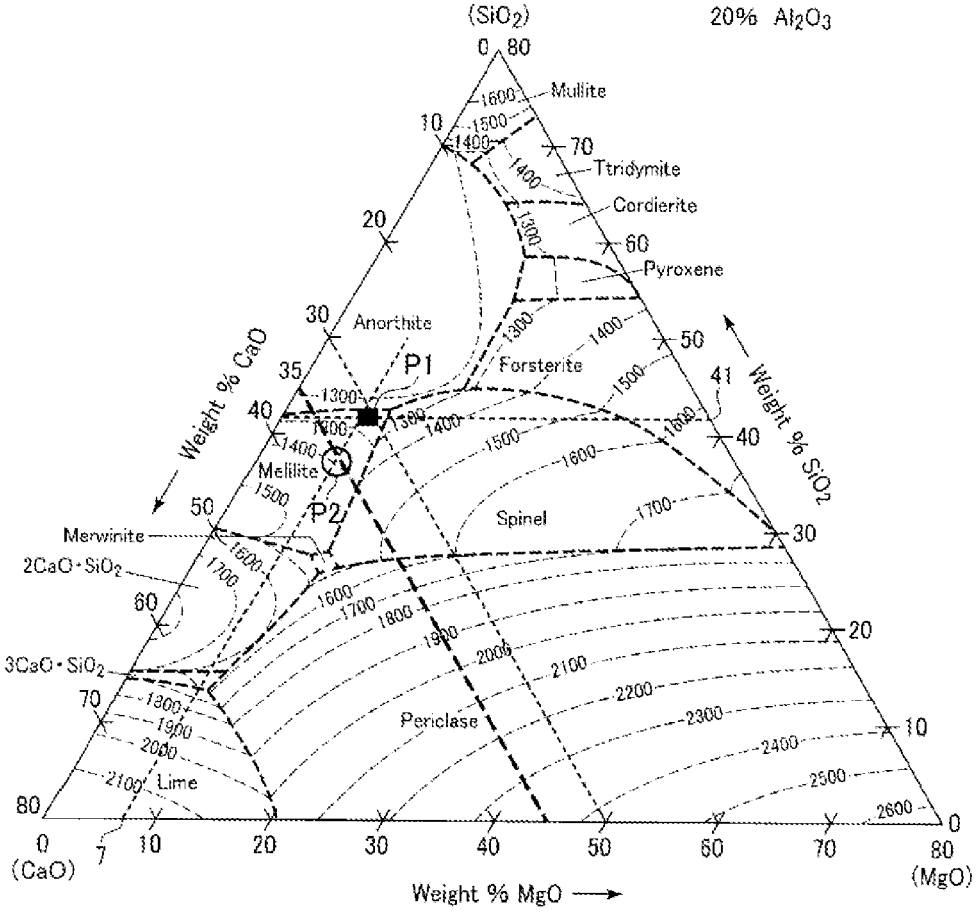
FIG. 3 is a quaternary system phase diagram of $SiO_2$—CaO—MgO-20% $Al_2O_3$ for blast-furnace injecting coal.

In FIG. 3, because the calcium oxide content that results in an ash melting point of 1400° C. is 35 wt. % (position of point P2), it is clear that mixing 95 wt. % of the coal and 5 wt. % of the blast-furnace slag resulted in the ash composition after mixing having a calcium oxide content of 35 wt. %, as shown in Table 3 below, and an ash melting point of 1400° C. Furthermore, 3 wt. % of cornstarch as a binder and 6 wt. % of water were added to the mixture of the coal and the blast-furnace slag.

TABLE 3

| $SiO_2$ (wt. %) | CaO (wt. %) | $Al_2O_3$ (wt. %) | MgO (wt. %) |
|---|---|---|---|
| 39 | 35 | 18 | 8 |

Thus, according to this working example, the composition of the coal ash and the melting point of the ash are analyzed and the composition of the blast-furnace slag is analyzed, and by using blast-furnace injecting coal in which the coal and the blast-furnace slag are mixed such that the calcium oxide content causes the melting point of the ash to be 1400° C. based on these analysis results, it is possible to raise the melting point of the ash above the temperature of the hot wind injected into the interior from the tuyere on the bottom side of the side part of the blast-furnace body of a blast furnace, and it is possible to suppress adhesion of the blast-furnace-injecting-coal ash or blockages caused by the blast-furnace-injecting-coal ash along the path of the blast-furnace injecting coal to the interior of the blast-furnace body, at low cost.

Furthermore, in the above description, a method for producing blast-furnace injecting coal in which the mixed amounts of coal and blast-furnace slag are determined using a quaternary system phase diagram including $SiO_2$—CaO—MgO-20% $Al_2O_3$ was described, but this is because the ash melting point is more dependent on the calcium oxide content than on the content of silicon dioxide, magnesium oxide or aluminum oxide, and the mixed amounts of coal and blast-furnace slag are adjusted based on the calcium oxide content. Additionally, the reason that a quaternary system phase diagram including $SiO_2$—CaO—MgO—

$Al_2O_3$ for the case where the aluminum oxide content is 20 wt. % was used is that there is little change in aluminum oxide content when from 5% to 10% of blast-furnace slag is mixed with the coal, and it results in nearly the same phase diagram as the case where the content of aluminum oxide is 20 wt. %.

INDUSTRIAL APPLICABILITY

The blast-furnace injecting coal and the method for producing the same according to the present invention can, at low cost, suppress adhesion of the blast-furnace-injecting-coal ash and blockages caused by the blast-furnace-injecting-coal ash along the path of the blast-furnace injecting coal to the interior of the blast-furnace body, and therefore can be utilized extremely advantageously in the steelmaking industry.

REFERENCE SIGNS LIST

11 Coal
12 Blast-furnace slag
13, 23 Blast-furnace injecting coal
24 Binder
25 Water
P1 Melting temperature of coal ash
P2 Melting temperature of ash from mixture
S11-1, S11-2 Analysis steps
S12-1, S12-2 Fine pulverization steps
S13 Mixing step
S14 Pulverization step
S25 Molding step

The invention claimed is:

1. A method for producing blast-furnace injecting coal which produces blast-furnace injecting coal to be injected through a tuyere into an interior of a blast-furnace body of a blast furnace, the method comprising performing:

an analysis step of analyzing a composition and a melting point of coal ash and analyzing a composition of an iron and steel slag produced by an iron and steel production step; and a mixing step, in which the iron and steel slag contains more calcium oxide than the coal ash does, and the coal and the iron and steel slag are mixed on the basis of the composition and melting point of the coal ash and the composition of the iron and steel slag, and in a manner such that a content of calcium oxide contained in a quaternary system phase diagram including silicon dioxide, magnesium oxide, aluminum oxide and calcium oxide, which are principal components of the coal ash and the iron and steel slag, causes the melting point of the ash to be 1400° C. or higher.

2. The method for producing blast-furnace injecting coal according to claim 1, wherein the coal has been pulverized to an average particle size of not greater than 1 mm, and the iron and steel slag has been pulverized to a particle size of 20 μm to 100 μm.

3. The method for producing blast-furnace injecting coal according to claim 2, the method further comprising performing:

in the mixing step, further adding a binder and water, and mixing with the coal and the iron and steel slag; and a molding step in which the mixture obtained in the mixing step is molded into briquettes.

* * * * *